US006911165B2

(12) United States Patent
Sahala et al.

(10) Patent No.: US 6,911,165 B2
(45) Date of Patent: Jun. 28, 2005

(54) METHOD FOR FABRICATING CONCRETE SLABS USING A HORIZONTAL SLIP CASTING PROCESS

(75) Inventors: Tarmo Sahala, Valkeakoski (FI); Aimo Seppänen, Sääksmäki (FI); Lassi Järvinen, Valkeakoski (FI)

(73) Assignee: Consolis Technology Oy AB, Vantaa (FI)

( * ) Notice: Subject to any disclaimer, the term of this patent is extended or adjusted under 35 U.S.C. 154(b) by 41 days.

(21) Appl. No.: 10/404,103

(22) Filed: Apr. 2, 2003

(65) Prior Publication Data

US 2003/0227102 A1 Dec. 11, 2003

(30) Foreign Application Priority Data

Apr. 2, 2002 (FI) ..... 20020630

(51) Int. Cl.[7] ..... B28B 7/16; B28B 1/44; B28B 3/20; B28B 3/22

(52) U.S. Cl. ..... 264/33; 264/35; 264/39; 264/70; 264/209.1; 264/211.11; 264/313; 264/318; 425/64; 425/114; 425/185; 425/440; 425/465; 425/3; 249/177; 249/183

(58) Field of Search ..... 264/33, 35, 70, 264/209.1, 211.11, 39, 313, 318; 425/64, 114, 185, 440, 468, 3; 249/177, 183

(56) References Cited

U.S. PATENT DOCUMENTS

| | | | | | |
|---|---|---|---|---|---|
| 1,730,472 | A | * | 10/1929 | Murray | 264/259 |
| 2,614,310 | A | * | 10/1952 | Maxwell | 249/176 |
| 3,082,504 | A | * | 3/1963 | Tatsch | 264/31 |
| 3,200,177 | A | * | 8/1965 | Dodd | 264/70 |
| 3,469,817 | A | * | 9/1969 | Bowden et al. | 249/183 |
| 3,892,826 | A | | 7/1975 | Yost | |
| 4,077,599 | A | * | 3/1978 | Oland | 249/177 |
| 4,089,502 | A | * | 5/1978 | Miller | 249/177 |
| 4,378,203 | A | * | 3/1983 | Nayagam | 425/111 |
| 4,594,205 | A | * | 6/1986 | Wunderlich et al. | 264/31 |
| 4,642,964 | A | * | 2/1987 | Kellison | 52/699 |
| 4,706,927 | A | * | 11/1987 | Lawall | 249/177 |
| 4,723,900 | A | * | 2/1988 | Vuorenoja | 425/204 |
| 4,755,338 | A | * | 7/1988 | Harala | 264/209.2 |
| 5,156,791 | A | * | 10/1992 | Sano et al. | 264/219 |
| 5,651,911 | A | * | 7/1997 | Pennypacker | 249/94 |
| 5,976,442 | A | * | 11/1999 | Manning | 264/228 |
| 6,110,402 | A | * | 8/2000 | Miller | 264/31 |

FOREIGN PATENT DOCUMENTS

| | | |
|---|---|---|
| DE | 9207374 U1 | 9/1991 |
| EP | 0493140 A1 | 7/1992 |
| FI | 89398 | 6/1993 |
| FI | 111611 B | 8/2003 |

OTHER PUBLICATIONS

Hohe Maβgenauigkeit bei geringer Rüstzeit, Betonwerk + Fertigteil–Technik, Apr. 1986, p. 275.

* cited by examiner

*Primary Examiner*—Michael P. Colaianni
*Assistant Examiner*—Michael I. Poe
(74) *Attorney, Agent, or Firm*—Burns, Doane, Swecker & Mathis, LLP

(57) ABSTRACT

A method is provided for fabricating a concrete slab in a substantially horizontal slip casting process method, concrete mix is fed into a mold through a delimited cross section moving progressively in the casting process so as to form a concrete product of a desired shape. Onto the surface of the casting bed (1) is placed a core (3, 9, 10, 11) capable of delimiting the cross section of the concrete product (5, 5') so as to provide an opening or a provision for an opening in the bottom surface of the slab. A core is provided for obtaining an opening or a provision for an opening. The structure and/or material of the core is/are such that the core is capable of yielding in vertical direction. A core may also be a multipart core, the outer part of which becomes detached from the inner part of the core in conjunction with lifting off the concrete slab from the casting bed.

19 Claims, 3 Drawing Sheets

METHOD FOR FABRICATING CONCRETE SLABS USING A HORIZONTAL SLIP CASTING PROCESS

FIELD OF THE INVENTION

The present invention relates to a method and a core for fabricating a concrete slab by continuous slip casting, wherein an opening or a recess for optional later provision for an opening is made In the bottom surface of the slab during casting.

BACKGROUND OF THE INVENTION

In extruder-type continuous casting, concrete is extruded through the mold or nozzles of a moving casting machine by means of auger feeders and the ready-cast product remains setting on a stationary casting bed. The casting machine is propelled, e.g. by the reaction forces of the auger feeders. Other possible slip casting techniques are, e.g., the so-called slip-former technique. If so desired, hollow-core cavities can be made in the product during casting by means of shaping mandrels. The hollow-core cavities may be used, e.g., as installation ducts for piping and cables.

To accomplish such installations, an opening leading into the cavity has to be made in the surface of the hollow-core slab. The opening is usually made at the plant onto the slab resting on the casting bed by removing concrete at the cavity while the cast concrete still is fresh. If an opening is needed only in the bottom surface of the slab, it is necessary to make first an opening in the top surface of the slab resting on the casting bed only after which an opening in the bottom surface can be made. The opening made in the top surface of the slab is thus unnecessary and remains to be filled later, for instance at the construction site. Openings are also necessary in solid-core slabs, e.g. floor planks, e.g. for leading-through of sewer, air-conditioning and water pipes and electrical wiring. This kind of openings are also made at the plant by digging an opening from the top surface of the slab to the bottom surface of the slab.

Openings leading also into the hollow-core cavities are needed at the bottom surface of a hollow-core slab, e.g., as an outlet for water possibly accumulating in the cavities. These kinds of openings, e.g., relatively small water drainage openings, are normally made in the slabs at the plant the same way as described above and/or, e.g., at the construction site by drilling the finished product.

In slip casting, e.g. in the extruder or slip former techniques, the moving casting machine, instead of the casting bed, comprises also the sides that define the sides of the product. As soon as the continuously moving casting machine has traveled forward and the ready-cast product is left resting on the casting bed, the product must be in stable form and be self-supporting. This sets requirements for the concrete mix used, as known in the art. The fed concrete mix has to be dry enough so that after compaction during casting, also the hollow-core-cavities will retain their shape.

Earlier it has not been possible to incorporate separate cores on the casting bed in order to provide openings or recesses constituting provisions for openings in the bottom surface of the slab during slip casting using relatively dry concrete mix,

SUMMARY OF THE INVENTION

It is an object of the present invention to provide a novel manufacturing method by means of which an opening, or a recess for optional later provision for an opening that can be broken through later if needed, can be obtained in the bottom surface of a concrete slab during the slip casting process. In the method according to the invention, a hole is made to the bottom surface of the slab to be cast, in a hollow-core slab substantially coinciding with a hollow-core cavity of the slab, by means of a core placed on the casting bed. The hole leads from the bottom surface of the solid-core slab to the top surface thereof, or into a cavity so as to form an opening, or, in the case of a recess for optional later provision for an opening, a thin concrete film separates the hole from top surface of a solid core slab or from the cavity of a hollow-core slab, in the cured product.

More specifically, the method according to the invention is characterized in that a core is placed on the surface of the casting bed, substantially coinciding with a cavity to be formed into the hollow-core slab, to additionally define the cross section of the concrete product to provide an opening or a recess for optional later provision for an opening in the bottom surface of the slab.

The invention also relates to a core for providing an opening in a concrete product in a slip casting process. More specifically, the core according to the invention is characterized in that the structure and/or material of the core is such that the core is capable of yielding at least partially in its vertical direction. An embodiment of the core according to the invention is characterized in that the core comprises an outer part, which advantageously is adapted to become detached from the inner core part when the cast concrete slab is elevated from the casting bed, and an inner part that advantageously is adapted to remain attached to the casting bed when the concrete slab is lifted off the casting bed.

The method according to the invention is based on placing on the casting bed a core, which enables an opening or recess for optional later provision for an opening in the slab to be cast. In case of a hollow-core slab, the core is located substantially at the site of a cavity of the hollow core. As the casting process proceeds, the casting machine casts concrete over the core, whereby a hole with the shape and thickness of the core is formed at the location of the core into the bottom surface of the slab. The thickness of the core may be adapted such that the surface(s) delimiting the top surface of the slab being cast or the hollow-core-cavity forming parts pass above the core so as to leave a concrete film of suitable thickness between the core and the surface(s) delimiting the slab top surface or, between the core and the hollow-core-cavity-forming mandrel. By thickness of the core is meant the vertical dimension of the core (i.e. height). This is how a recess for optional later provision for an opening is obtained. The said concrete film is thin enough for being broken through in the finished, cured product.

When the method according to the invention is employed at the manufacturing plant to make a through opening, i.e. a connection from the bottom surface of the slab to the cavity without a concrete film separating the hole from the cavity, a suitable core is used, preferably a core according to the present invention, whose material and/or structure yields when the casting machine passes over it and which core after the passage of the casting machine recovers its original dimensions in the vertical direction either partially or entirely, thus punching an opening into the fresh concrete film formed. This kind of said core may be e.g. a core which comprises several parts, or a part of the core, which is pressed downwards under pressure imposed thereon.

Formation of openings or recesses for optional later provisions for openings with a method according to the present invention sets requirements for a concrete mix used. The fed concrete mix has to be dry enough that the product, possibly containing also thin concrete films and left setting on the casting bed, will retain its shape.

Hence, a ready-cast solid-core slab may be provided with recesses for optional later provisions for openings at desired locations and a ready-cast hollow-core slab can have on one surface (bottom surface) one or more openings and/or recesses for optional later provisions for openings produced according to method of the invention and at desired places on the opposite surface (top surface) also openings made at the casting plant. Thus, at the construction site an opening leading from the bottom surface of the slab to the top surface of the slab or into a hollow-core cavity thereof can easily be made by breaking the thin concrete film, e.g. with a hammer, at a suitable location either entirely or partially. Especially e.g., for openings needed for water drainage, the bottom surface of the slab may be provided with small openings, whereby drilling of the slab is avoided. Water drainage holes are needed particularly in hollow-core slabs. In the present text, the term bottom surface of the slab refers to the surface of the slab facing the casting bed, while the term top surface of the slab refers to the opposite surface. Depending on the application and/or slab type, the slab may at its final erection site be installed in a position desired in which case the mentioned bottom surface of the slab need not be oriented downwards.

Among others, the invention offers the following remarkable benefits:

- There is no need at the plant to break first the top surface of a hollow-core slab in order to make an opening to the bottom surface of the slab. As a result, cost savings are achieved both at the manufacturing plant and at the construction site due to the elimination of such a procedure and due to the elimination of the need for filling the unnecessary openings, respectively.
- There is no need at the plant to dig unnecessary openings into solid-core slabs possibly needed in the leading-through of piping and wiring. As well, the need for filling such unnecessary openings is avoided.
- The number, location and shape of openings and/or recesses for optional later provisions for openings can be adjusted easily because of easy attachment of the core on the casting bed and easy detachment of the same therefrom.
- In a fault situation during the casting process the core is easy to relocate
- By providing a recess for optional later provision for an opening larger than the dimensions of the opening needed, it is easy to rectify dimensional errors detected at the construction site because the recess for optional later provision for an opening, which is larger than required, does not restrict the opening to be broken exactly at the precise location decided in advance.
- Water drainage holes at the bottom surface of the slab need not be made by drilling.

BRIEF DESCRIPTION OF THE DRAWINGS

Next, the invention will be explained in greater detail by making reference to the attached drawings, wherein.

DESCRIPTION OF THE PREFERRED EMBODIMENTS

Figure 1A:
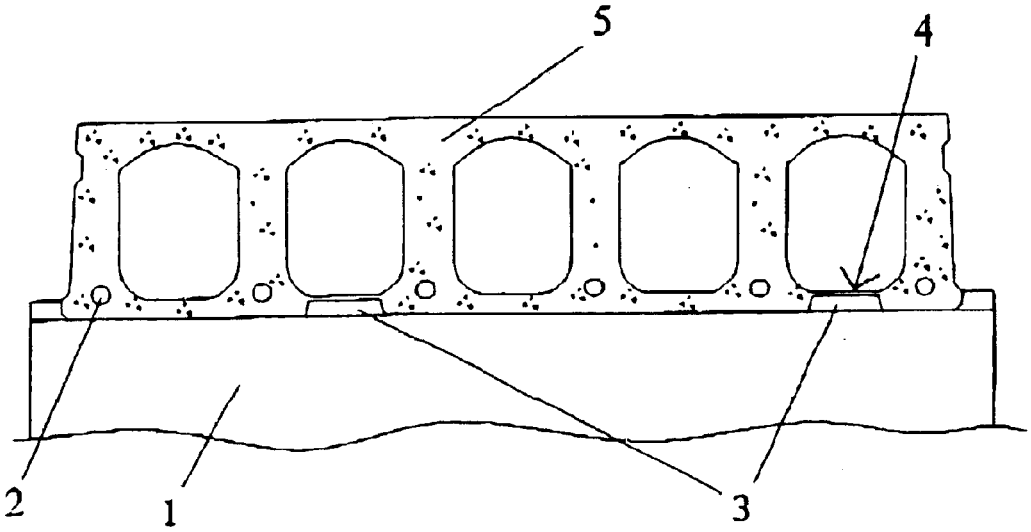
FIG. 1*a* shows a cross-sectional view of a hollow-core slab illustrating positioning of cores according to the invention.
Figure 1B:
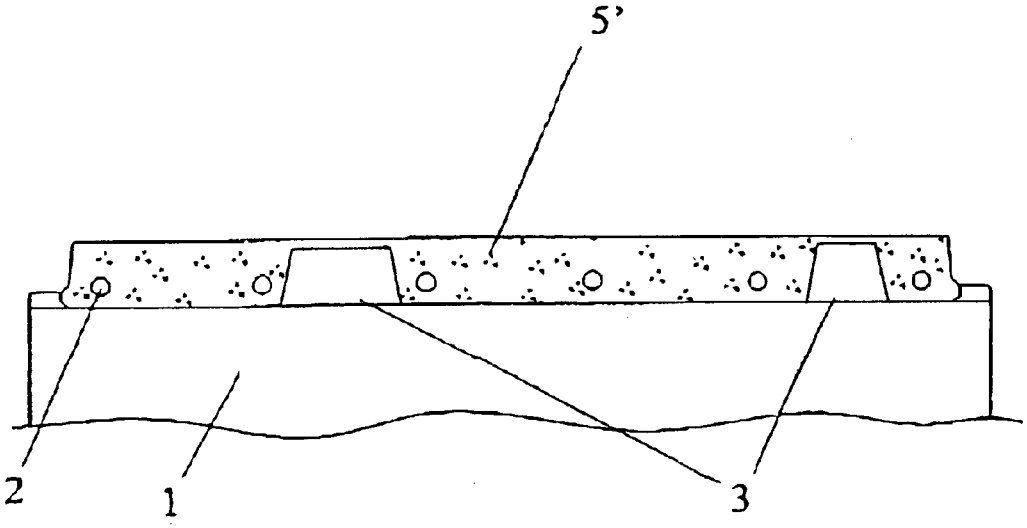
FIG. 1*b* shows a cross-sectional view of a solid-core slab illustrating the positioning of cores according to the invention.

FIG. 1*a* illustrates how the hollow-core slabs may be fabricated by slip casting with a method according to the invention, for instance, as follows: Prior to the casting operation, on a metallic casting bed, i.e. a mold 1, steel-wire pre-stressing strands 2 are pre-stressed, serving later as reinforcement in a pre-stressed element, and cores 3 are attached at desired locations in the mold coinciding with the hollow-core cavities in the casting direction. Concrete mix is poured into the feeder hopper of the slip casting machine, wherefrom the concrete falls onto the auger feeders. The rotating auger feeders force the concrete mix into a pressurized space delimited by the core-shaping mandrels and the walls delimiting the molding space, whereby the concrete mix is compacted and shaped so as to provide the final shape of the end product. The ready-cast end product 5 remains resting on the stationary casting bed for curing, while the casting machine continues to travel propelled by, e.g., the reaction forces generated by the auger feeders. The concrete mix may also be introduced onto the casting bed e.g. by pouring or pumping along troughs and fabricate a solid-core slab or a slab comprising hollow-core cavities using the slip-former casting technique well known in the art. In FIG. 1*b* is shown location of a core on a casting bed in the manufacture of a solid-core slab.

Also the core delimits the casting space, whereby during casting the travel of the casting machine over the core produces at the bottom surface of the slab, a hole whose shape and size correspond to those of the core. The core thickness may be adapted such that the surface(s) of the casting machine delimiting the top surface of the solid core slab or the core-cavity shaping mandrels travel over the core so that a relatively thin concrete film 4 is left on the top surface of the core. The thickness of the concrete film is preferably 3 to 10 mm and more preferably 3 to 5 mm. A concrete film which is too thin can cause problems during casting, e.g., a part of the casting machine may interfere with the core. When a recess for optional later provision for an opening is to be made by the method according to the invention, the thickness of the film is at most such that it can be broken through in a ready-cast and cured product. Hence, it is easy to make into a finished product an opening from the bottom surface of the slab to the top surface of a solid-core slab or, an opening into a cavity of a hollow-core slab, by way of breaking, e.g. with a hammer, the thin concrete film either entirely or partially. When an opening is made with a method according to the invention, the thickness of the concrete film is maximally such that the tension build up in the core is sufficient to puncture an opening into the concrete film.

When the method according to the invention is employed at a plant for obtaining a hollow-core slab with an opening, i.e. a connection from the slab bottom surface to a cavity without a concrete film, casting is performed principally in the same way as described above, but using a suitable core which punctures the formed concrete film after casting. Such a core may be, e.g., an assembly of parts with different elastic properties or, a core wherein, e.g., part of the core yields downwards (under imposed pressure) when the casting machine travels over the said core, and which core after the passage of the casting machine thereover recovers partially or entirely its original dimensions in the vertical direction thus puncturing an opening into the formed fresh concrete film.

Figure 2:
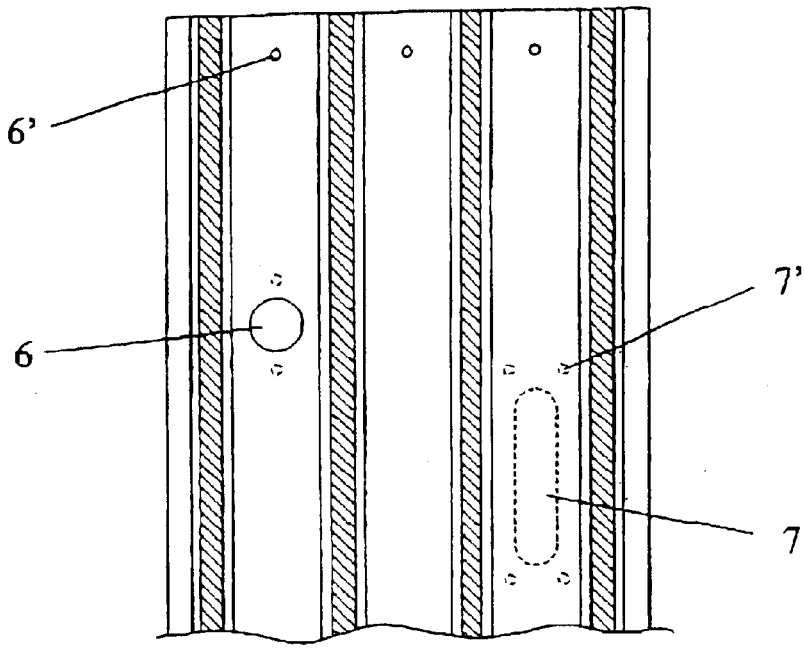
FIG. 2 shows a longitudinal section view of a hollow-core slab manufactured according to the invention.

In FIG. 2 are shown in the bottom surface of a hollow-core slab some possible locations of openings 6, 6' and/or recesses for optional later provisions for openings 7, 7' to be obtained according to the invention. The cores may be placed by one or several hollow-core cavities. In the casting direction, that is, in the longitudinal direction of the hollow-core cavity, cores may be located at different locations and in different numbers compared to adjacent cavities. Hence, the location of openings and recesses for optional later provisions for openings on the slab surface and, hence location and number of cores on the casting bed vary according to the intended use of the slabs, openings and recesses for optional later provisions for openings. In the selection of the number and location of the cores, attention must also be paid to remain the load-bearing capability of the slab sufficient. For instance, in a hollow-core slab, the length of which is e.g. 6 to 10 m long, e.g. one to two openings 6, 7, can be needed e.g., for cable and/or piping installations. If the number of such openings is two, for instance, they are advantageously located e.g. at both ends of the slab. Small openings 6', 7', i.e. water drainage holes, are generally provided for each cavity, advantageously at both ends of a hollow-core cavity, and furthermore, a suitable number advantageously close to larger openings intended for e.g. installation of electrical cables and piping. In a solid-core slab, a suitable number of recesses for optional later provisions for openings per slab may be made at suitable locations, however, paying attention to sufficient load-bearing capability of the slab.

A finished hollow-core slab may contain one or several openings and/or recesses for optional later provisions for openings on one surface (bottom surface) using the method according to the invention, and the opposite surface (top surface) may also contain at desired locations openings made at the plant by digging out fresh concrete mix. Possible openings in the slab top surface may be provided at locations different from the openings and/or recesses for optional later provisions for openings made in the bottom surface of the slab and the sizes of the top-surface openings may vary and their number may differ from the number of openings and/or recesses for optional later provisions for openings made in the slab bottom surface. Recesses for provisions for openings may be provided at desired locations in a ready-made solid-core slab.

Figure 3:
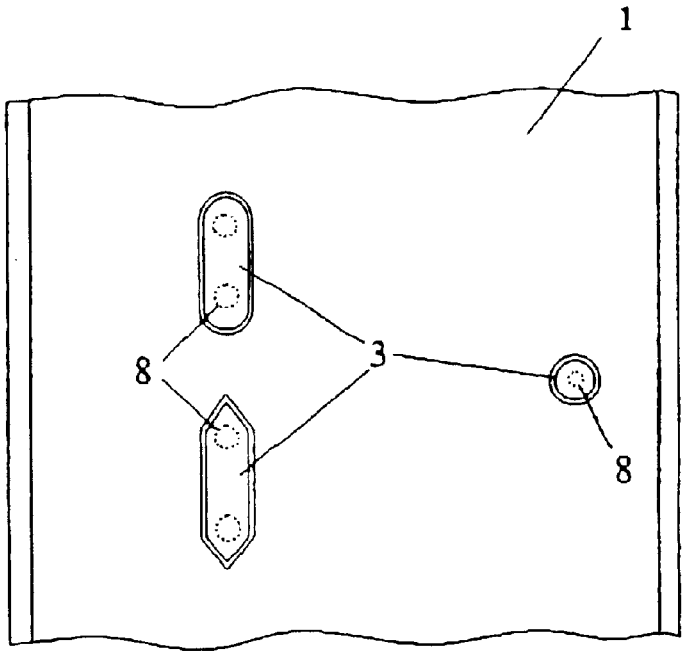
FIG. 3 shows some preferred embodiments of the cores used in the method according to the invention as located on a casting bed.

In FIG. 3 are shown some preferred embodiments of the cores 3 used in the method according to the invention attached to a casting bed 1. The shape of the core facing the casting mold may be, e.g., circular, ellipsoidal or polygonal and often symmetrical. The thickness of the core may vary so that the gap between the surfaces delimiting the top surface of the solid-core slab or the lower edge of the core-cavity-forming mandrel and the top surface of the core is preferably about 3–10 mm, more preferably 3–5 mm. Depending on end-use, the distance of the lower edge of the core-shaping mandrel from the casting bed varies normally, e.g. advantageously between about 25 and 60 mm, and the thickness of a solid-core floor plank may, depending on its application, vary advantageously between about 50 and 150 mm. The dimensions of the core in the plane of the casting bed, such as core diameter, length and width, may vary according to the needs in the end-use of the slab and/or opening. For instance, openings needed for electrical cabling are often round having a diameter of about 70 to 95 mm, and air-conditioning ducts require an opening having a diameter from 100 to 160 mm. Openings intended for water drainage from a hollow-core cavity generally have a diameter of about 10 to 15 mm. The openings needed may also be longitudinal slits with a length of 2 m, for instance.

The cores may incorporate one or more magnets 8 for attaching the core on a metallic casting bed. The cores may also be attached on the mold by any other suitable way, e.g. with screws, or advantageously by glueing or by glueing with a hot-melt glue. Attachment with a magnet is particularly advantageous allowing rapid attachment of cores at suitable points of the casting bed as specified for the product. Further, detachment of cores equipped with magnets is easy after casting, and without leaving attachment marks on the casting bed that might cause problems during the next casting operation. When the cured cast slabs are detached from the casting bed, the cores or the inner parts of the cores remain on the surface of the casting bed, wherefrom they are removed, e.g., in order to change their position.

In glueing or holt-melt glueing, it is advantageous to use glue, whose strength diminishes as a function of time after curing. It is particularly advantageous to use a glue having, after setting, a sufficient strength to keep the core at its place during casting, but which glue begins to lose strength after casting. Hence, when the strength of the glue has decreased after sufficient time from the start of casting, the core can be easily detached from the casting bed, and possibly placed in a new location at the casting bed.

The cores can be located on the casting bed either manually or by mechanical means.

The core can be made of any material suitable for the application. Hence, the core can be made of, e.g., expanded polystyrene, be ceramic, be advantageously made of rubber, wood, metal or plastic, or a combination of these when an opening or recess for optional later provision for an opening is to be obtained by means of the method according to the invention.

If the ratio of the thickness of the core to its surface area facing the casting bed is relatively large, as is the case when, e.g., a recess for a provision for an opening (or an opening) is to be obtained e.g. for a water drainage hole, a core attached in place with a magnet may detach, which is not wanted, from the casting bed when the dry, finished hollow-core slab is removed from the casting bed. Similarly, a core attached in place using glue with a time-delay strength diminishing property, may become detached from the casting bed with the concrete slab. However, a narrow core may be difficult to remove from the slab. Hence, particularly when such a narrow core is used, it is advantageous to use for core, facing the concrete, a material, whose adhesion to the concrete is as low as possible.

Figure 4C:
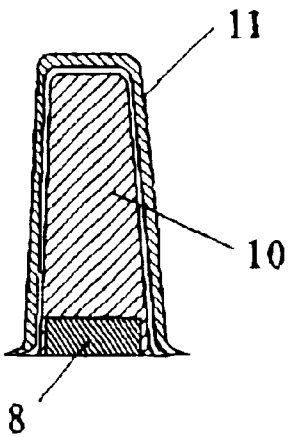
FIGS. 4*a*, 4*b* and 4*c* show sectional views of some preferred core embodiments according to the invention.
Figure 4B:
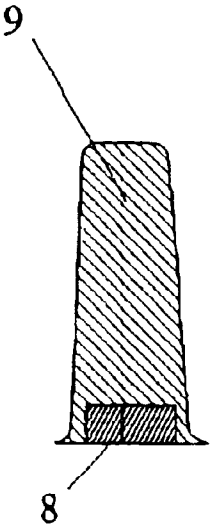
Figure 4A:
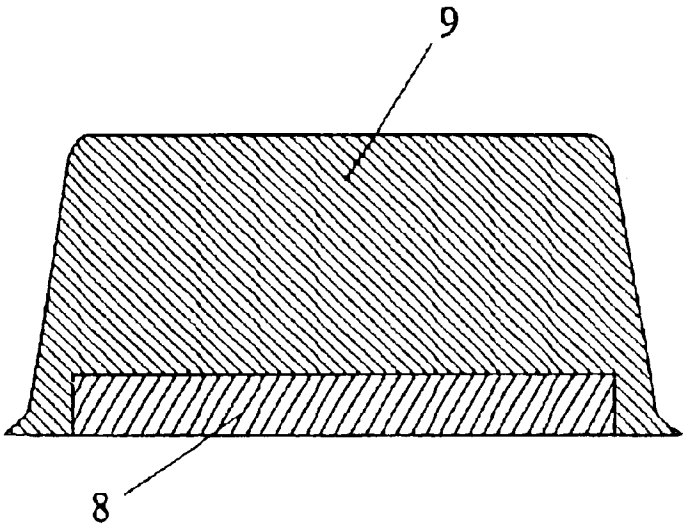

In FIGS. 4*a*, 4*b* and 4*c* are shown some preferred embodiments of cores according to the invention. In order to overcome the above-described problem, i.e. detachment of a narrow core from the concrete, one possibility is to use, e.g., a core (FIG. 4*c*) comprising an outer and an inner part. When such a combination core is used, the inner part of the core, advantageously the said core equipped with a magnet, can remain attached to the casting bed while the outer core is removed with the concrete slab. The material of the outer part of the core, or its surface material can be different from the material of the inner part of the core. When using the mentioned outer core part, the adhesion between the outer core part and concrete being low, the core or outer part of the core attached to it, is easy to detach afterwards from the concrete. Such outer parts of the core may be advantageously reused several times. Preferably, the core surface facing the concrete is also as smooth as possible to facilitate the detachment of the core from the concrete. The outer part of the core is advantageously made of plastic, for instance. The mentioned narrow type core may also be of one part, in which case the core surface facing concrete is advantageously coated with a low-adhesion material, e.g. with PTFE. Also the surface of the outer part of a multipart core can advantageously be coated with a low-adhesion material, e.g. with PTFE. The material of the core or part of the core facing concrete must possess sufficient stiffness to resist pressure imposed on it during casting. The shape of outer part of the core (i.e., the part facing the concrete) may, e.g., substantially follow the form of the inner core.

When producing openings using the method according to the invention, a core can be used, advantageously of the kind in accordance with the invention, whose structure and/or material is such that the core can yield at least partially at least in its vertical dimension. Some embodiments of this kind of core are such as e.g. those illustrated in FIGS. 4*a* and 4*b*, made of a material that may yield under the pressure generated during casting. The cores of FIGS. 4*a* and 4*b* comprise a magnet for attaching the core onto a casting bed. However, the magnet is not necessarily needed in the cores and they may as well be attached onto the casting bed by any other suitable way, for instance, by such ways of attachment, which are disclosed earlier in the text for attachment of cores onto a casting bed in conjunction for obtaining recesses for optional later provisions for openings in slip casting.

One further embodiment of a core according to the invention may be such core as is illustrated in FIG. 4*c*, comprising an outer part and an inner part, which core yields either entirely or partially in the vertical direction under pressure generated during the event of casting, so that the core or at least the outer part thereof during casting "evades" the casting machine by way of yielding downwards in vertical direction in such fashion that a thin concrete film remains between the lower edge of the core-shaping mandrel and the top of the core and, after the passage of the casting machine, the core or, alternatively, its outer part recovers its original dimensions in the vertical direction either partially or entirely thus punching an opening into the said concrete film.

The core or the outer and/or inner part of the core in accordance with the invention may be made of any material suitable to the purpose. The core can be made of, e.g., expanded polystyrene, be ceramic, or be advantageously made of rubber, wood, metal or plastic, or of any combination of these. A core that comprises several parts may be fabricated such that the parts of the core are of the same material or of different materials, and part of the core can be fabricated using more than one material, advantageously selected from the materials mentioned above.

To accomplish vertical compressibility of the core according to the invention, the lower portion of the outermost core may be made, e.g., of a material different from that used in the other portion of the outermost core, e.g. advantageously being more elastic plastic or rubber. This kind of lower edge which is made of the same or different material and is suitably elastic, advantageously also functions as a seal so that concrete mix is substantially prevented from entering between the outer part of the core and the inner part of the core during casting. The outer part of the core can be attached in a suitable way to the inner core part. The fixing of the outer part of the core with regard to the casting machine principal plane during casting may be enhanced e.g. by selecting the material of the lower edge of the outermost part of the core so, that the friction between said material and the casting bed is sufficient to fix the outer part of the core during casting.

What is claimed is:

1. A method for fabricating a concrete slab in a substantially horizontal slip casting process, in which method a relatively dry concrete mix is fed into a mold through a delimited cross section moving progressively in the casting process so as to form a self-supporting concrete slab of a desired shape, said delimited cross section having sides that define sides of the self-supporting concrete slab, wherein onto a surface of the mold is placed a core, said core delimiting a cross section of the self-supporting concrete slab during the casting process so as to provide an opening or a provision for an opening in a bottom surface of the concrete slab.

2. The method of claim 1, wherein a distance between a top of the core and surface(s) defining a top surface of a solid-core concrete slab is 3 mm to 10 mm.

3. The method of claim 1, wherein said core is made of a rubber, plastic, metal or wood material or a combination thereof.

4. The method of claim 1, wherein said core comprises a detachable outer part.

5. The method of claim 1, wherein a surface of the core facing concrete is coated with a material having a low adhesion to concrete.

6. The method of claim 1, wherein a structure and/or material of the core is such that the core is capable of yielding at least partially in a vertical direction.

7. The method of claim 1, wherein said core incorporates one or several magnets for attaching the core onto the surface of the casting bed.

8. The method of claim 1, wherein a distance between a top of the core and surface(s) defining a top surface of a solid-core concrete slab is 3 mm to 5 mm.

9. The method of claim 1, wherein a surface of the core facing concrete is coated with PTFE that exhibits a low adhesion to concrete.

10. The method of claim 1, wherein the core is attached to the surface of the casting bed by glue.

11. The method of claim 10 wherein the glue has a sufficient strength to keep the core fixed during casting, attached to the casting bed, and that after curing of the glue, the glue exhibits loss of strength as a function of time.

12. The method of claim 1, wherein said core is attached to the surface of the casting bed by gluing with hot-melt glue.

13. The method of claim 12 wherein the glue has a sufficient strength to keep the core fixed during casting, attached to the casting bed, and that after curing of the glue, the glue exhibits loss of strength as a function of time.

14. The method of claim 1, wherein the concrete slab is a hollow-core slab and that said core is located coinciding with a hollow-core cavity of the slab being cast.

15. The method of claim 14, wherein a distance between a top of the core and a lower edge of a mandrel shaping the hollow-core cavity is 3 mm to 5 mm.

16. The method of claim 14, wherein said core is made of a rubber, plastic, metal or wood material or a combination thereof.

17. The method of claim 14, wherein a distance between a top of the core and a lower edge of a mandrel shaping the hollow-core cavity is 3 mm to 10 mm.

18. The method of claim 17, wherein said core is made of a rubber, plastic, metal or wood material or a combination thereof.

19. A method for fabricating a concrete slab in a horizontal slip casting process comprising the steps of:

attaching cores at predetermined locations, which are coincident with hollow core cavities in the concrete slab, on a casting bed in a casting direction;

feeding a relatively dry concrete mix through a delimited cross section, which moves progressively during the curing process and which comprises sides that define sides of a self-supporting concrete slab, to form the self-supporting concrete slab of a desired shape; and curing the self-supporting concrete slab to form the concrete slab, wherein the cores delimit a cross section of the self-supporting concrete slab during the casting process so as to provide openings or provision for openings in a bottom surface of the concrete slab.

* * * * *